United States Patent [19]

Zimmermann et al.

[11] 4,225,129

[45] Sep. 30, 1980

[54] SHEET GUIDANCE ARRANGEMENT IN PRINTING-MACHINE OUTFEED UNITS

[75] Inventors: Hans Zimmermann, Coswig; Fritz Pieper; Konrad Blauth, both of Radebeul; Hartmut Nagel, Coswig, all of German Democratic Rep.

[73] Assignee: VEB Polygraph Leipzig Kombinat fuer Polygraphische Maschinen und Ausruestungen, Leipzig, Fed. Rep. of Germany

[21] Appl. No.: 6,927

[22] Filed: Jan. 26, 1979

[51] Int. Cl.[3] ..... B65H 29/04; B65H 29/36

[52] U.S. Cl. ..... 271/204; 271/183; 271/231

[58] Field of Search ..... 271/204, 182, 183, 196, 271/205, 206, 229, 231, 194; 198/689

[56] References Cited

U.S. PATENT DOCUMENTS

| | | | |
|---|---|---|---|
| 3,378,256 | 4/1968 | Ellis et al. | 271/183 |
| 3,595,564 | 7/1971 | De Young | 271/183 |
| 3,779,545 | 12/1973 | Schuhmann et al. | 271/204 |
| 4,013,284 | 3/1977 | Demetre | 271/204 |
| 4,148,476 | 4/1979 | Brekell | 198/689 |

*Primary Examiner*—Robert B. Reeves
*Assistant Examiner*—Brian Bond
*Attorney, Agent, or Firm*—Michael J. Striker

[57] ABSTRACT

Grippers pull the leading ends of sheets along a sheet transport path, and a guidance structure facilitates sheet travel. The guidance structure comprises a plurality of longitudinally extending guide bars provided with suction openings, the ribs spaced apart transverse to the sheet-transport direction. Intermediate the bars are large-surface-area plates having suction openings. When guiding sheets printed on only one side, the intermediate suction plates are at about the same level as the longitudinally extending guide bars, and the entire face of the sheet is engaged, with the help of suction force. When guiding sheets printed on both sides, the imtermediate suction plates all drop down out of contact with the sheet, leaving only the spaced apart and narrow longitudinal guide bars to engage the sheet. The guide bars are furthermore transversely shiftable, so that they can be brought into engagement with parts of the sheets bearing no printing.

4 Claims, 5 Drawing Figures

SHEET GUIDANCE ARRANGEMENT IN PRINTING-MACHINE OUTFEED UNITS

BACKGROUND OF THE INVENTION

The present invention concerns sheet guidance arrangements used in the sheet-outfeed units of printing machines. Such sheet guidance arrangements serve to improve the quality of the transport of printed sheets from the printing mechanisms of the printing machine per se through the sheet-outfeed unit of the machine, so that the sheet can be transported through the outfeed unit and deposited onto the outfeed stack without detrimental effects upon the print quality of the printing on the sheets.

Federal Republic of Germany published patent application DT-OS 2,137,115 discloses a sheet guidance arrangement for the sheet-outfeed unit of a printing machine. The sheet-transport path within the sheet-outfeed unit includes a curved section at which is arranged a guide plate which extends, transversely to the sheet-transport direction, for the full width of the transported sheets. The guide plate is provided with nozzles through which air is sucked. The sucked-air action exerts an underpressure upon the sheet, pulling the surface of the sheet into contact with the surface of the guide plate. As a result the sheet does not flutter but instead is transported stretched taught through the sheet-outfeed unit of the printing machine, then to the suction roller at the outfeed end of the outfeed unit, and is then deposited onto the outfeed stack.

With this known arrangement, an important drawback is that the entire surface of the sheet is pulled by means of suction into surface contact with the entire surface of the guide plate. If the sheet has been run through a printing machine operating in the two-sided-printing mode, i.e., so that both faces of the sheet bear freshly applied printing during transport through the sheet-outfeed unit, the printing on the side of the sheet pulled against the guide plate as a very great tendency to smear. As a direct result of this, such known sheet guidance arrangement is really suitable only for printing machines operating in the one-sided-printing mode, i.e., wherein the face of the sheet pulled into surface contact with the guide plate does not bear any printing at all.

SUMMARY OF THE INVENTION

It is the general object of the invention to provide a pneumatic-type guidance arrangement for printing-machine sheet-outfeed units equally well adapted for the guidance of sheets bearing freshly applied printing on just one or even both their sides.

It is a related object to provide a guidance arrangement of this type which is extremely simple in construction and operation, but nevertheless can be changed over for guidance of sheets which have been printed on only one side, or for sheets printed on both sides, so that maximum sheet-guidance action can be achieved for both cases.

In accordance with the present invention, this is accomplished using a sheet-guidance arrangement in which sheets printed on both sides, or more generally on the side physically contacting the guidance arrangement, are supported by low-surface-area guide structures extending along the length of the sheet transport path, these guide structures being spaced from each other.

According to a further concept of the invention, these guide structures are adjustable or shiftable in the direction transverse to the sheet-transport direction, so that they can be adjustably located at portions of the sheet where the sheet face being engaged does not bear printing.

According to another concept of the invention, intermediate these guide structures are one or more suction-plate structures, for example in the form of suction boxes with each box having suction apertures, the suction-plate structures being mounted for quick and simple movement between a first position in which they engage the same face of the sheet engaged by the longitudinally extending guide structures, and a second position in which they do not thusly engage the sheet.

In the preferred embodiment of the invention, the suction plates or suction boxes comprise one of the sides of a four-cornered or parallelogram-type mechanism or linkage, and plural such suction plates or boxes succeed each other in the direction proceeding along the sheet-transport path, with all such suction plates or boxes coupled together so as to all move in unison from the aforementioned first to second positions, or vice versa, for quick changeovers between one-sided and two-sided printing.

To revent bulging of sheets, it is preferred that the infeed end of the sheet-outfeed unit be provided with anti-bulge or flattening structure which is moved into a position engaging the sheets for the case of one-sided printing but moved out of engagement with the sheets for two-sided printing.

Preferably, the anti-bulge or flattening structure is mechanically coupled to the suction plates or boxes, so that all such components move from first to second position, or vice versa, simultaneously, as a single changeover movement.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
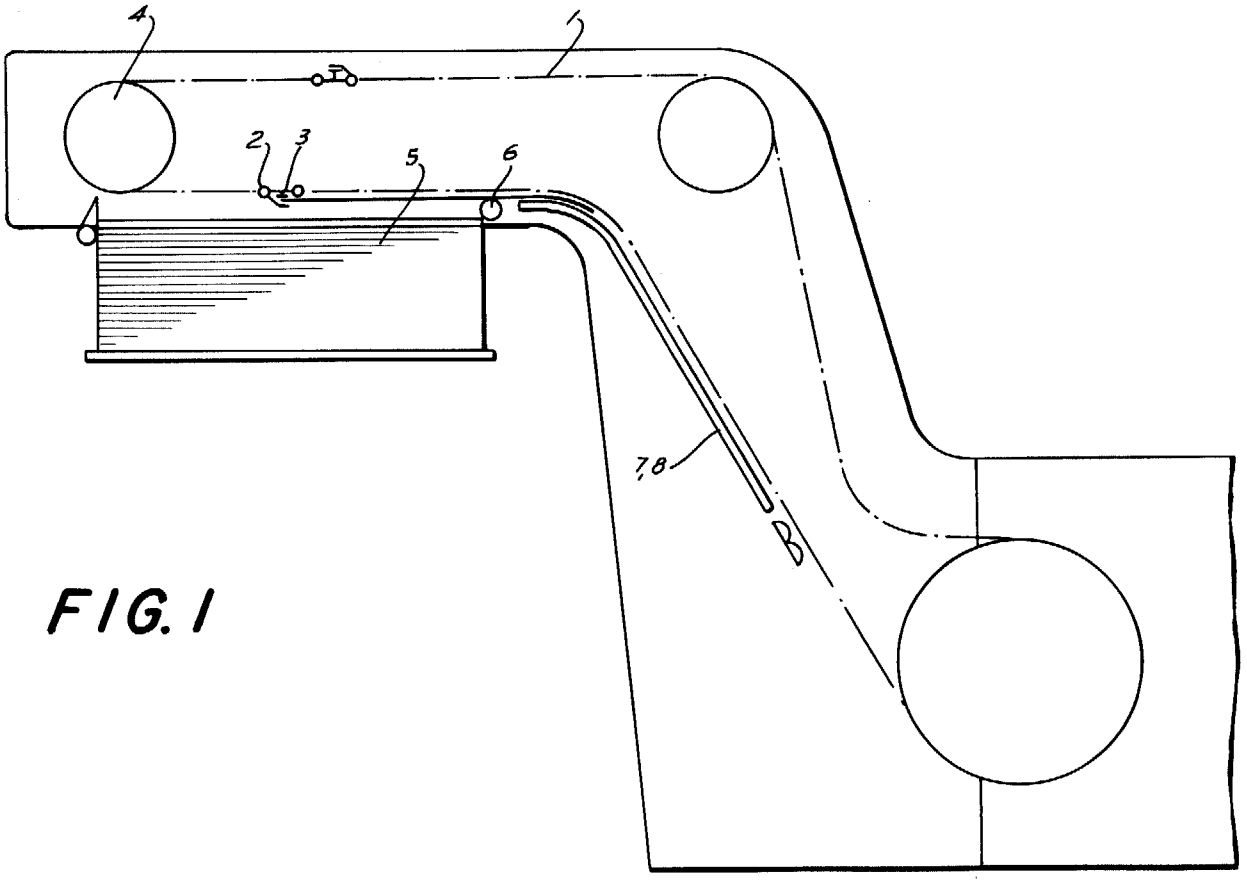
FIG. 1 is a simplified and schematic side view of the sheet-outfeed unit of a print machine, provided with a sheet-guidance arrangement in accordance with the present invention.

FIG. 1 is a very schematic side view of the sheet-outfeed unit of a printing machine. The outfeed unit includes a chain loop 1, on which are arranged at equal intervals pick-up units 2 provided with sheet grippers 3.

Of the part of the sheet-outfeed unit not per se novel, there are also illustrated the roller 4 about which the chain loop 1 travels, and the conventional suction roller 6. Numerals 7, 8 denote the here very schematically depicted novel sheet-guidance arrangement of the present invention.

Figure 2:
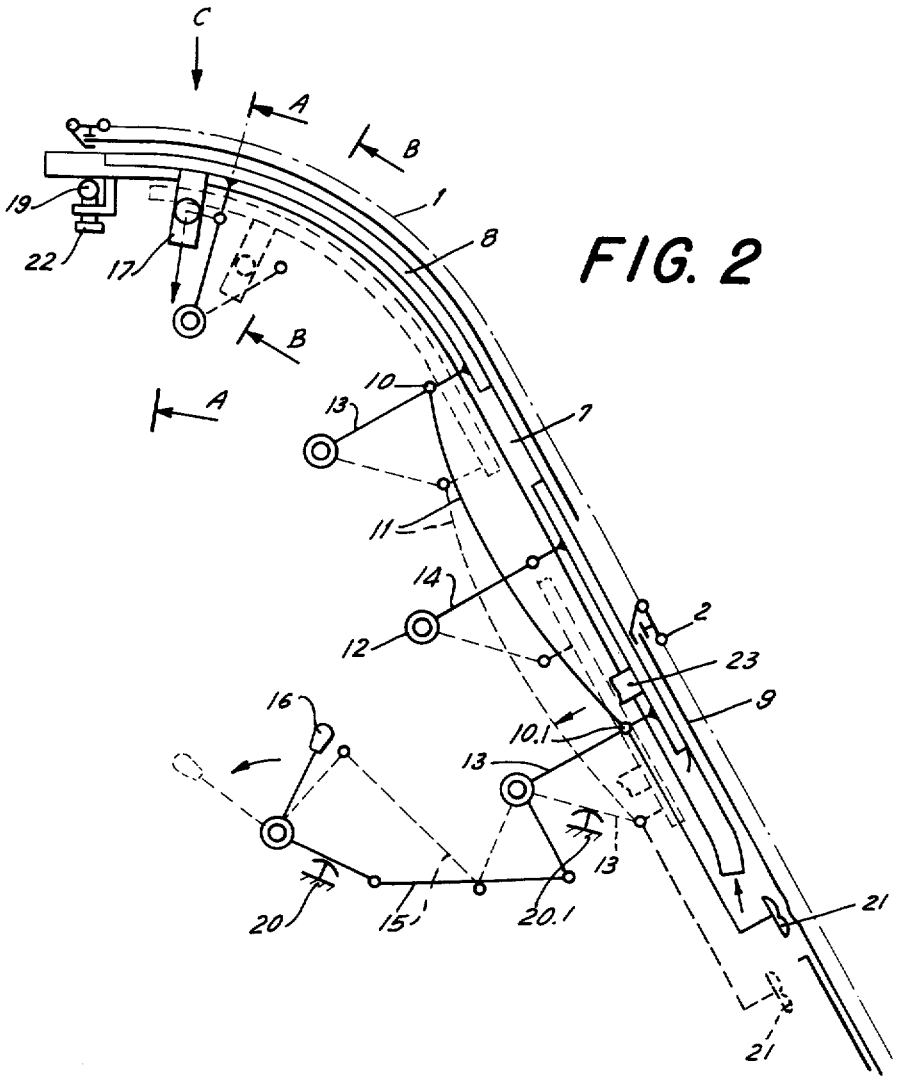
FIG. 2 is a more detailed side view of the sheet-guidance arrangement schematically shown in FIG. 1.
Figure 3:
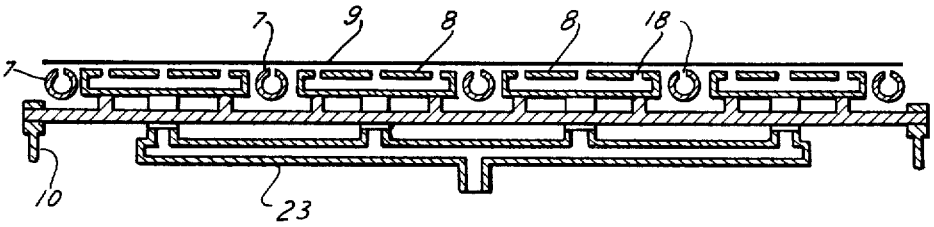
FIG. 3 is a section taken along line A—A of FIG. 2, with the sheet-guidance structure being in the setting thereof used for one-sided printing.
Figure 4:
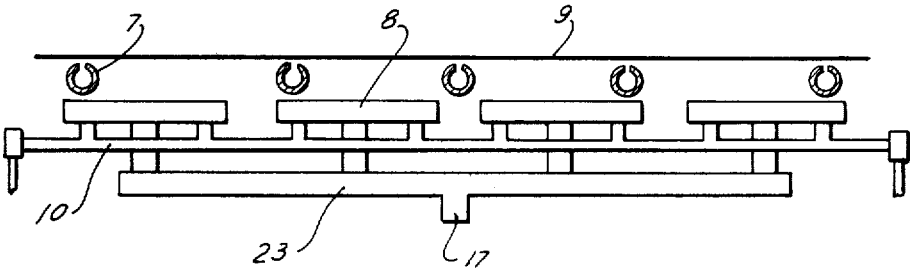
FIG. 4 is a section taken along line B—B of FIG. 2, with the sheet-guidance structure being in the setting thereof used for two-sided printing.
Figure 5:
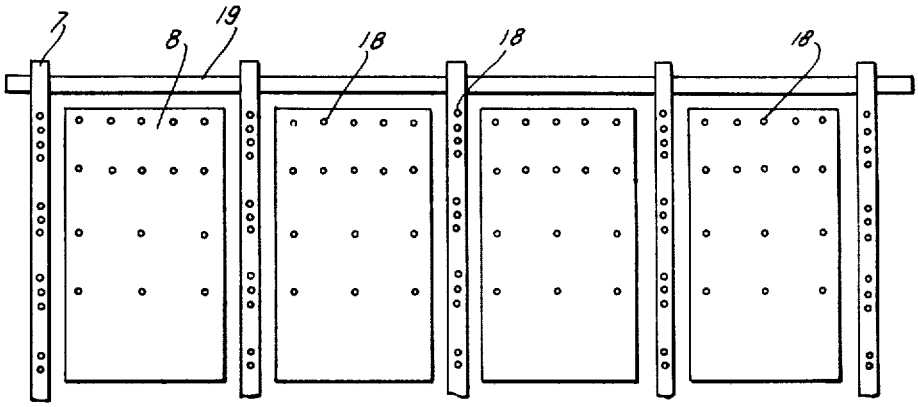
FIG. 5 is a top view looking down upon the sheet-guidance structure of FIG. 2 in the direction of arrow C in FIG. 2.

FIG. 2 is a detailed side view of one exemplary version of the sheet-guidance arrangement 7, 8 of FIG. 1. FIGS. 3 and 4 are sections taken along lines A—A and B—B of FIG. 2, showing the guidance arrangement in the one-sided and two-sided modes of printing operation, and FIG. 5 is a top view looking down in the direction of arrow C in FIG. 2. The sheet-guidance arrangements of FIGS. 2–5 comprises a plurality of sheet guide bars 7, spaced from each other in the direction transverse to the sheet-transport direction, and each extending longitudinally, i.e., in the direction of sheet transport. Located intermediate adjoining longitudinal sheet guide bars 7 are suction plates 8, here in the form of suction boxes whose upper faces are apertured and constitute suction plates. These suction boxes 8 are connected to a (non-illustrated) source of suction. In the illustrated embodiment, i.e., as seen in FIG. 2, there are two transversely extending rows of suction boxes 8, the lower row comprising straight boxes 8 and the upper one curved boxes 8; as shown in FIG. 5, each such transverse row of suction boxes 8 here contains four such suction boxes, located intermediate adjoining ones of five longitudinal guide bars 7. Each transverse row of suction boxes 8 is securely and rigidly mounted on two transversely extending crossbars 10.

Each longitudinal guide bar 7, at both its lower and upper end, is secured to a shared or common transverse pipe 19 by means of releasable clamping screws 22 and is mounted on such pipe transversely shiftable, i.e., in the left-right direction as viewed in FIG. 5. In FIG. 2, only the upper one of these two transverse pipes 19 is shown.

As shown in FIGS. 2–4, the suction boxes 8 can be moved to two positions in terms of the spacing of their upper apertured suction plates relative to the lower faces of transported sheets 9. As shown in FIG. 3, and in solid lines in FIG. 2, for guiding sheets printed on only one side, the suction boxes 8 are located at approximately the same distance from the sheets 9 as are the longitudinal guide rods 7; preferably, the suction boxes 8 are here located a slight amount higher than flush with the upper sides of the guide rods 7. As shown in FIG. 4, and in broken lines in FIG. 2, for guiding sheets printed on both sides, the suction boxes 8 are swung down to a position lower than the longitudinal guide bars 7.

The longitudinal guide bars 7 and the suction boxes 8 are connected to a common pneumatic pump, or to respective pneumatic pumps if, as described below, simultaneous suction and blowing is employed. The suction boxes 8 are connected to a suction pipe 23, i.e., each transverse row of suction boxes 8 (one such row shown in FIG. 5) is connected to a respective such suction pipe. The transmission of suction force to the guide bars 7 is controllable independently of the transmission of suction force to the suction boxes 8; for the sake of simplicity, the means transmitting suction to the longitudinal guide bars 7 is not depicted.

Both the longitudinal guide bars 7 and the suction boxes 8 are provided with apertures 18 facing the transported sheets 9, as most clearly seen in FIG. 5. The suction boxes 8 are swingably mounted on a stationary part 12 of the sheet-outfeed unit by means of first and second levers 13, 14 coupled to the transverse crossbars 10. The first and second levers 13, 14 form, together with the suction boxes 8 themselves, a four-cornered or parallelogram-type mechanism 13, 8, 14, in which the suction boxes 8 constitute one side of the parallelogram. A longitudinally extending coupling rod 11, secured to the crossbar 10 of one set of boxes 8 and to the crossbar 10.1 of the other set, couples the two parallelogram-type mechanisms 13, 8, 14 together, for joint movement.

The lower or upstream parallelogram-type mechanism 13, 8, 14 is associated with the manual-control area of the sheet-outfeed unit, via the first lever 13 itself, which here is of two-armed and angled design, via a coupling rod 15 and a hand lever 16. Hand lever 16, coupling rod 15 and first lever 13 are coupled together for swinging movement between the solid-line positions shown in FIG. 2 and the broken-line positions shown in FIG. 2. The pivot shaft of hand lever 16, like the pivot shafts of first levers 13 and those of second levers 14, are mounted on stationary parts 12 of the housing of the sheet-outfeed unit. A stationary stop structure 20 serves to determine the end position of the mechanism when the mechanism is moved to its setting for one-sided printing, whereas another such stationary stop 20.1 determines the end position of the mechanism for two-sided printing, as shown in FIG. 2. In both end positions of the mechanism, the end position is stably maintained by virtue of the weight of the suction boxes 8 themselves. Upstream of the sheet-guidance structure 7, 8 there is arranged on both sides of the first transverse crossbar 10.1 a sheet-unrolling roller 21.

It will be understood that the present invention is not at all limited to the specific embodiment herein illustrated. For example, it is possible not to have two suction boxes 8, i.e., as considered in the sheet-transport direction, but instead only a single one, for example located at the turnover point of chain loop 1 or immediately upstream of the suction roller 6. Likewise, it need not be the case that the suction boxes 8 serve as a coupling member, i.e., as one side, of the four-corner or parallelogram-type mechanism 13, 8, 14. What is important, however, is that, when changing over from one-sided to two-sided printing, or vice versa, the suction boxes shift between one setting and the other quickly, easily and reliably. Also, whereas suction boxes 8 are here illustrated, other such means could be used, for example larger-surface-area blow-suction elements operating, in accordance with the aerodynamic paradox, to apply an underpressure to the sheets 9.

Furthermore, whereas the illustrated sheet-guidance structure here is shown used in a printing machine's sheet-outfeed unit, it could be otherwise used and located, e.g., along the sheet transport path intermediate or below two printing stations of a printing machine.

The illustrated embodiment operates as follows:

After exiting the last printing station of the printing machine, the sheet 9 is engaged at its leading edge by the sheet gripper 3, and is continuously transported along the length of chain loop 1 through the sheet-outfeed unit and finally deposited onto the outfeed stack 5.

One-sided printing:

For emerging sheets which have been printed only on one side, the suction boxes 8 are located in approximately the same plane as the longitudinal sheet guide bars 7. The longitudinal guide bars 7 and/or the suction boxes 8 are in receipt of suction, so as to exert suction via their apertures 18 upon the underface of the sheet 9 and pull the sheet against the sheet-guiding structure 7, 8, so that the sheet 9 be transported through the sheet-outfeed unit in a stretched tight condition. In this mode of operation, the sheet-unrolling or -uncurling roller 21 is swung into the sheet-transport path and is likewise in receipt of suction. In per se conventional manner, the sheet-uncurling roller 21 serves to counteract the curvature imparted to the sheet 9 as a consequence of the printing process itself.

Two-sided printing:

After the changeover to two-sided printing, the hand lever 16 is shifted in the direction of the arrow (FIG. 2), and through the intermediary of the coupling rod 15, the four-corner or parallelogram-type mechanisms 13, 18, 14 of FIG. 2, i.e., both of them, change from their solid-line settings (FIG. 2) to their broken-line settings, the parallelogram-type mechanism coming to a rest against stop member 20.1 and being pressed thereagainst by the inherent weight of the suction boxes 8 themselves, i.e., as is also the case for the solid-line setting of this mechanism but in that case against stop member 20.

This shiftover of hand lever 16 simultaneously serves to swing sheet-uncurling roller 21 out of the sheet-transport path.

The clamping screws 22 which secure the sheet guide rods 7 to the cross pipes 19 are loosened, and the guide bars 7 are shifted, in the direction transverse to the sheet-transport direction, into positions falling upon unprinted strips or columns of the sheet, and then once more clamped firmly into position.

As will be clear, the longitudinal coupling rod 11 serves to assure that all suction boxes 8 change setting simultaneously in response to a shiftover of the hand lever 16.

Thus, during actual operation, the longitudinal guide bars 7 are in receipt of suction. This suction force pulls the sheet 9 against the sheet guide bars 7, but without detrimentally affecting the printed image on the sheet.

In order to prevent transported sheets 9 from drooping down into the spaces intermediate adjoining longitudinal guide bars 7, the suction boxes can be furnished with superatmospheric pressure, instead of subatmospheric pressure, in order to blow against the sheet 9 and in that way counteract drooping.

The valves or other controls used to switch on and off the supply of suction force to longitudinal guide bars 7 and suction boxes 8, and to switch on and off the supply of superatmospheric pressure to the suction boxes 8 if blowing action is employed for two-sided printing, are preferably operatively coupled to the illustrated mechanism, e.g., by limit switches located on the stop structures 20, 20.1, so that suction force is turned on and off or switched over into blowing force simultaneously with the shiftover of the hand lever 16.

If for any reason necessary, it is also possible, when receiving sheets printed on both sides, to leave the illustrated sheet-guidance arrangement 7, 8 in its one-sided-printing-mode setting, and then to supply both the longitudinal guide bars 7 and the suction boxes 8 with overpressure, not suction. The air blown out from nozzles 18 serves to create an air cushion upon which the sheets 9 can then be carried without physically contacting the structure 7, 8 itself.

It will be understood that each of the elements described above, or two or more together, may also find a useful application in other types of constructions differing from the types described above.

While the invention has been illustrated and described as embodied in a sheet-guidance arrangement used in the context of the sheet-outfeed unit of a printing machine, it is not intended to bc limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a sheet transport device of the type wherein transported sheets move along a path defined by a sheet-transport means, a sheet-guidance arrangement comprising: a plurality of longitudinal guide elements extending in the direction of sheet transport and adapted to be shifted in the direction transverse to the sheet-transport direction, said guide elements being spaced apart in the transverse direction, said guide elements having apertures therein connectable to a source of suction; supporting means to provide the shifting movement of said longitudinal guide elements; suction means for supplying pneumatic force to the transporting sheets, said suction means including longitudinal guide boxes positioned intermediate said longitudinal guide elements in the space provided therebetween and having apertures associated with pneumatic conduits; and means for moving said suction means away from the sheet-transport path to a position spaced from said path whereat the suction means is retained stationary and is incapable of contact with the sheet during transport of the sheet, said means for moving said suction means including a four-bar parallelogram-type mechanism two bars of which are coupled with said longitudinal guide boxes.

2. The sheet-guidance arrangement of claim 1, wherein said longitudinal guide boxes are positioned one after another proceeding in the direction of sheet transport.

3. The sheet-guidance arrangement of claim 2, wherein said means for moving said suction means comprising a plurality of four-bar parallelogram-type mechanisms located, like said boxes, one after the other proceeding in the direction of sheet transport, and further including coupling means coupling together the plural four-bar parallelogram-type mechanism for joint movement.

4. The sheet-guidance arrangement of claim 1, furthermore including a sheet-uncurling roller and means mounting the latter at the upstream end of said boxes for movement away from the sheet-transport path jointly with said boxes.

* * * * *